United States Patent [19]

Wallis

[11] 3,947,005

[45] Mar. 30, 1976

[54] FLUID SPRING ASSEMBLY

[76] Inventor: Bernard J. Wallis, 25200 Trowbridge Ave., Dearborn, Mich. 48124

[22] Filed: Dec. 24, 1974

[21] Appl. No.: 536,084

Related U.S. Application Data

[63] Continuation-in-part of Ser. No. 475,040, May 31, 1974, abandoned.

[52] U.S. Cl. ..... 267/119; 267/130

[51] Int. Cl.[2] ..... F16F 9/10

[58] Field of Search ..... 267/119, 130, 65 A, 65 R

[56] References Cited

UNITED STATES PATENTS 3,180,634 4/1965 Heiser ..... 267/119

3,202,411 8/1965 Heiser ..... 267/119

*Primary Examiner*—James B. Marbert

*Attorney, Agent, or Firm*—Barnes, Kisselle, Raisch & Choate

[57] ABSTRACT

A die arrangement wherein selected dies are attached to their respective supports by fluid springs in the form of piston-cylinder assemblies which are in turn resiliently mounted on the die supports for pivotal movement as a unit.

20 Claims, 9 Drawing Figures

FLUID SPRING ASSEMBLY

This application is a continuation-in-part of my copending earlier application Ser. No. 475,040, filed May 31, 1974 now abandoned.

This invention relates to fluid springs and, more particularly, to a die arrangement wherein fluid springs are utilized for yieldably resisting movement of various die members toward the supports on which the die members are mounted.

The use of elastic rubber pads, mechanical springs and fluid springs for the application of a yieldable resisting force to a die member is well known in the metal forming industry. When fluid springs are used in such arrangements they sometimes take the form of a piston-cylinder assembly so designed as to permit the piston and the piston rod to pivot slightly relative to the axis of the cylinder in order to compensate for slight misalignment of relatively movable die members. While such arrangements have met with some success, they are not entirely satisfactory. The seals employed between the axially moving surfaces of the cylinder and the piston rod and piston must be capable of a substantial amount of flexing while still retaining their sealing capabilities. Such seals are not only relatively expensive, but, because of the severe conditions under which they are used, in many applications they must be replaced periodically.

The present invention has for its object the provision of a fluid spring assembly which permits slight misalignment of the relatively movable die parts and at the same time utilizes conventional, commercially available seals between the cylinder and the piston and piston rod.

More specifically, the present invention contemplates a piston-cylinder assembly arranged between a die member and its support wherein the entire piston-cylinder assembly is resiliently mounted for slight tilting movement relative to its support and resiliently flexible seals are disposed between the sliding parts thereof.

According to the present invention the piston-cylinder assembly is resiliently mounted in a metal sleeve to enable the assembly to tilt as a whole slightly relative to the sleeve. The sleeve is in turn rigidly mounted on the support for the die member controlled by the fluid spring.

Figure 1:
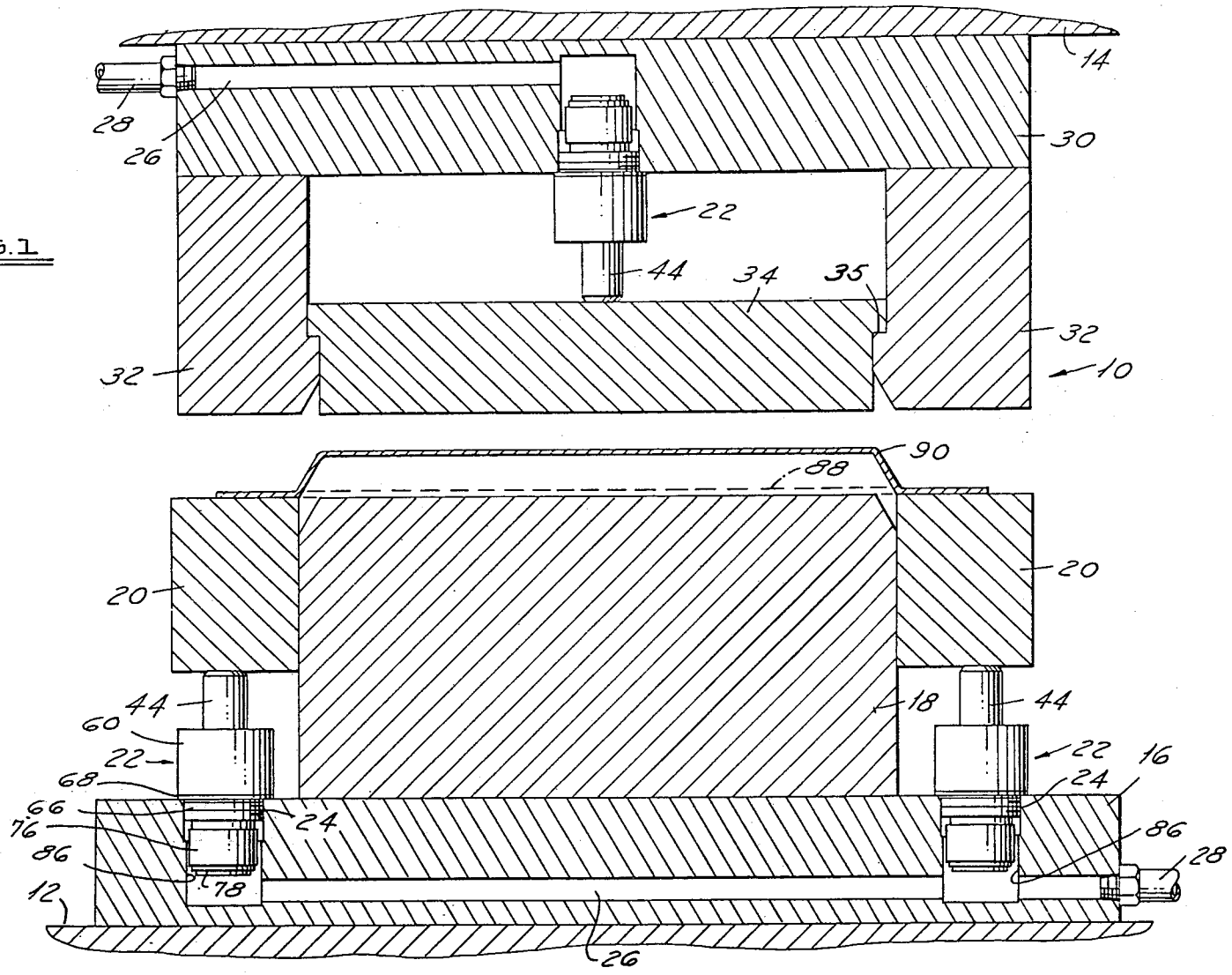
FIG. 1 is a fragmentary sectional view of a die arrangement according to the present invention.

Referring to FIG. 1 there is illustrated a die assembly 10 adapted to be mounted within a conventional stamping press. Die assembly 10 includes a support plate 12 on which the lower die set is mounted and a support plate 14 on which the upper die set is mounted. Vertically extending guide pins (not illustrated) on plate 12 extend through openings on plate 14 so that plate 14 is constrained to move toward and away from plate 12 in a rectilinear path perpendicular to the die supporting faces of these two plates. The lower die set includes an adapter plate 16 mounted on lower plate 12. A die 18 is fixedly mounted on adapter plate 16. In the arrangement illustrated a pressure pad 20 is positioned adjacent each end of die 18. Each pressure pad 20 is supported on adapter plate 16 by a plurality of fluid spring assemblies 22. Each fluid spring assembly is rigidly connected to adapter plate 16 as by a threaded connection 24. The lower end of each fluid spring assembly 22 is in communication with a fluid passageway 26 in adapter plate 16. Passageway 26 is in turn connected by a flexible conduit 28 with a pressurized fluid accumulator (not illustrated), preferably an accumulator charged with an inert gas, such as nitrogen.

The upper die set likewise includes an adapter plate 30 rigidly mounted on the upper support plate 14. A pair of die members 32 are fixedly mounted on adapter plate 30 to register vertically with the pressure pads 20 on the lower die set. Between the members 32 there is arranged a stripper die 34 which is supported for vertical movement on members 32. Shoulders 35 interconnect members 32 and 34 to prevent stripper die 34 from moving downwardly relative to members 32 beyond the position shown in FIG. 1. Die member 34 is biased downwardly by one or more fluid spring assemblies 22 of similar construction with those employed in the lower die set. The upper fluid spring assemblies are mounted in upper adapter plate 30 in the same manner that the lower die spring assemblies are mounted in the lower adapter plate 16. Adapter plate 30, like plate 16, is in the form of a fluid manifold having one or more passageways 26 therein communicating with the inner ends of the fluid spring assemblies thereon and connected to a pressurized fluid accumulator.

Figure 2:
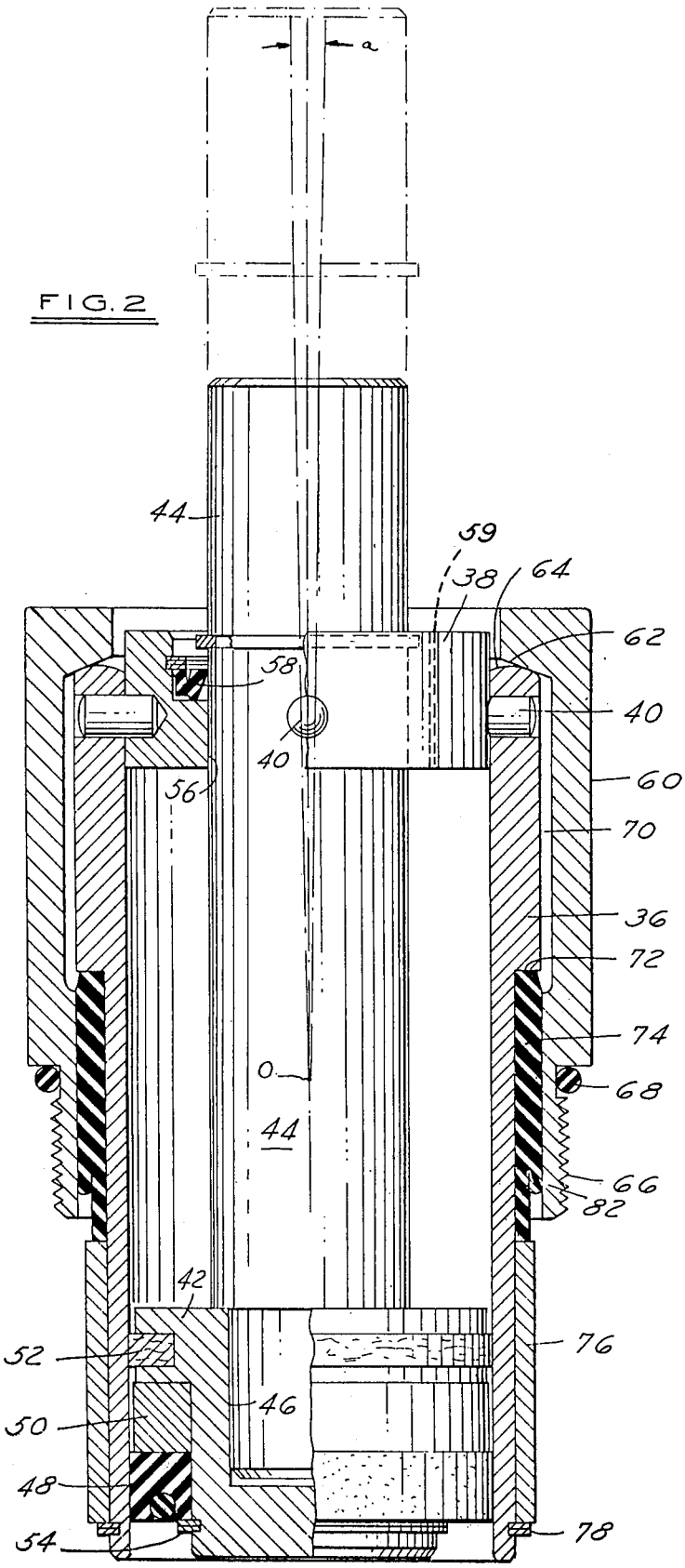
FIG. 2 is a longitudinal sectional view of one of the fluid springs shown in FIG. 1.

Referring now to FIG. 2, each fluid spring assembly 22 comprises a cylinder in the form of a metal sleeve 36 having a bushing 38 fixedly secured at one end thereof as by dowel pins 40. Within cylinder 36 there is arranged for axial reciprocation a piston 42 which is fixedly connected to one end of a piston rod 44 as at 46. Piston 42 is provided with a conventional rubber seal 48 which is backed by a ring 50 of anti-friction material. Piston 42 is also grooved to receive an oil-soaked felt wiper ring 52. Seal 48 and ring 50 are retained in place on the piston by snap rings 54.

Piston rod 44 extends upwardly through a close fitting bore 56 in bushing 38. Bore 56 is concentric with the axis of cylinder 36. A dust seal 58 on bushing 38 surrounds rod 44 and a vent 59 in bushing 38 permits the ingress of dirt and the ingress and the egress of air from the cylinder chamber.

A metal sleeve 60 surrounds cylinder 36 and is fashioned with a radially inwardly extending inclined shoulder 62 adjacent the rod end of the cylinder. The corresponding end of cylinder 36 is rounded as at 64 and is engaged with the annular shoulder 62. The opposite end portion of member 36 is threaded as at 66 for establishing the threaded connection with the respective adapter plate, as shown at 24 in FIG. 1. Adjacent threaded portion 66 there is arranged a rubber O-ring 68 which forms a fluid tight connection between each member 60 and the threaded bore in its respective adapter plate.

Figure 3:
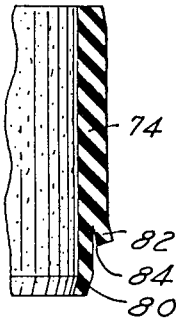
FIG. 3 is a fragmentary sectional view of the sleeve for resiliently mounting the fluid cylinder.

It will be observed that adjacent the rod end of cylinder 36 there is a radial clearance 70 between the inner periphery of member 60 and the outer periphery of cylinder sleeve 36. The opposite end of member 60 is, likewise, radially spaced from cylinder sleeve 36. Intermediate its ends cylinder sleeve 36 is fashioned with a radially outwardly extending shoulder 72 around its outer periphery. A resiliently flexible sleeve 74, formed of rubber or the like, is arranged around the outer surface of cylinder sleeve 36 with one end abutting shoulder 72. The opposite end of sleeve 74 abuts a spacer sleeve 76 which surrounds the inner end of cylinder sleeve 36 and is retained thereon by snap rings 78. Around its outer periphery sleeve 74 engages the inner periphery of annular member 60. Sleeve 74 is compressed at least slightly between cylinder sleeve 36 and annular member 60. In its relaxed condition sleeve 74 has the cross section shown in FIG. 3. It is provided with a slightly inwardly inclined lip 80 at its lower end and with an outwardly inclined lip 82 spaced above the inwardly inclined lip 80. Lip 82 is formed to provide a downwardly opening recess 84 with the adjacent section of the sleeve. When sleeve 74 is arranged on cylinder 36 as shown in FIG. 2 and annular member 60 is forced thereover, lip 80 tightly engages the outer surface of cylinder sleeve 36 and lip 82 closes recess 84 and tightly engages the inner periphery of annular member 60.

When fluid spring assemblies 22 are threaded into their respective adapter plates as shown in FIG. 1, the lower ends of the assemblies are disposed within the bores 86 in radially spaced relation thereto. The pressure of the fluid in passageway 26 and bores 86 acts against the undersides of pistons 42 and against the lips 80,82, the latter providing a tightly sealed connection between cylinder sleeves 36 and annular members 60. O-rings 68 form a sealed connection between annular members 60 and the adapter plate. The upper or free ends of piston rods 44 abut against the undersides of pads 20. The upper fluid spring assemblies 22 are mounted in the same manner on upper adapter plate 30 and their piston rods 44 abut against the upper face of male die 34.

In operation a sheet metal blank 88 is supported upon the upper faces of pads 20. Top plate 14 of the die set is driven downwardly so that the blank is clamped around its edges between pads 20 and members 32. As the upper plate 14 continues to descend, downward movement of pads 20 is yieldably resisted by the pressure fluid from the accumulator acting on the fluid springs through passageway 26. Likewise, the upward movement of die member 34 is yieldably resisted to a predetermined extent by the pressure fluid acting on the fluid springs on the upper adapter plate 30. In this manner blank 88 is formed by being stretched over die 18 to form the stamping 90 which is ejected by stripper 34.

In the event that either the lower die set or the upper die set is slightly inclined relative to the other, it will be appreciated that as the die sets move relatively toward one another the slight misalignment therebetween will cause the respective cylinders 36 to cock or pivot slightly relative to the central axes of annular members 60. This slight tilting or cocking movement is permitted by the resilient sleeves 74 and is facilitated by the rounded ends 64 of cylinder sleeve 36 engaging the inclined annular shoulders 62 of members 60. Thus, even though the force applied by one of the die members against the other is not exactly parallel with the rectilinear path of die travel, the piston rods 44 and the pistons 42 rigidly connected therewith move coaxially within the bores of their respective cylinder sleeves 36. Thus, the seals on the pistons are not subjected to excessive wear or distortion. In the arrangement illustrated in FIG. 2 the cocking or tilting movement of cylinder 36 relative to the member 60 occurs generally about the point O and the maximum angular extent of this pivot action is designated *a.* Normally angle *a* would have a maximum value of about 5°.

Figure 4:
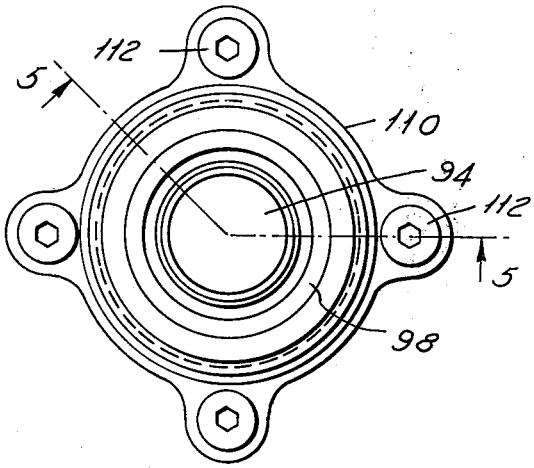
FIG. 4 is a top plan view of a first modified form of fluid spring according to this invention.

In the embodiments hereinafter described it is understood that the general die arrangement is substantially the same as that shown in FIG. 1, the differences in the modifications residing in the design of the fluid spring assembly and the manner in which it is mounted on its manifold plate. In the arrangement illustrated in FIGS. 4 and 5 the piston 92 is of substantially the same construction as the piston previously described, but is attached to piston rod 94 by means of a pin 96. The bushing 98 at the upper end of cylinder sleeve 100 is of substantially the same construction as the bushing 38 previously described and is secured to cylinder sleeve 100 in substantially the same manner. However, in this embodiment cylinder sleeve 100 is provided with an annular shoulder 102 which is generally of spherical shape. The portion of cylinder sleeve 100 below shoulder 102 projects into the bore 86 in the respective adapter plate 16. A seal between the outer periphery of cylinder sleeve 100 and bore 86 is provided by an O-ring 104 and a backing ring 106 seated in an annular groove 108 in the outer periphery of the cylinder sleeve 100. Sleeve 100 is located within a ring 110 which is secured to adapter plate 16 by a series of screws 112. Ring 110 is formed with an annular shoulder 114 complementary to shoulder 102. The center of the radius of curvature of shoulders 102 and 114 is located at the point designated O in FIG. 5. The outer periphery of cylinder sleeve 100 is spaced inwardly of the inner peripheral surfaces of bore 86 and ring 110 to allow for slight tilting movement of cylinder sleeve 100 relative to ring 110. It will be noted that O-ring 104 is located in the horizontal plane of point O. Thus, as cylinder sleeve 100 tilts the extent of tilting movement of O-ring 104 and consequently the wear thereon are minimized.

A dirt seal between ring 110 and cylinder sleeve 100 is provided by a resilient ring 116 which is retained in place against the upper end of ring 110 by a snap ring 118. Snap ring 118 also serves to maintain shoulders 102 and 114 interengaged. Sealing ring 116 prevents the ingress and accumulation of drawing compound, dirt, etc. in the clearance space between ring 110 and cylinder sleeve 100.

Figure 5:
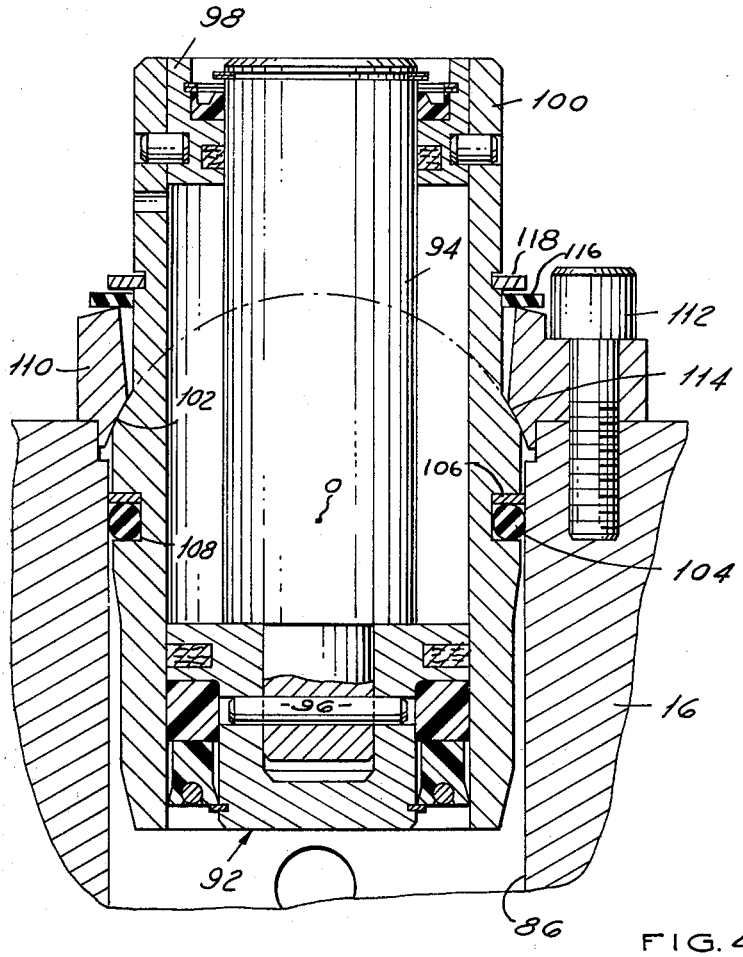
FIG. 5 is a sectional view taken along the line 5—5 in FIG. 4.

Comparing the structure shown in FIG. 5 with that shown in FIG. 2 it will be observed that the fluid spring shown in FIG. 5 incorporates several desirable features. For example, the annular ring 110 is relatively short, snap ring 118 cooperates with shoulder 102 and ring 110 to positively prevent axial separation of the parts, and O-ring 104 is subjected to less movement and less internal stress than the rubber sleeve 74 in FIG. 2.

Figure 6:
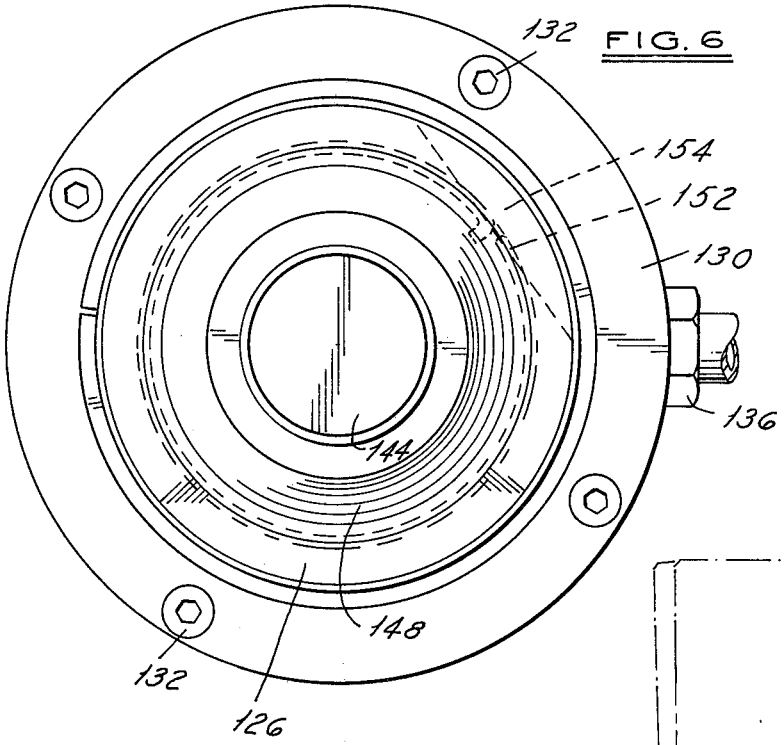
FIG. 6 is a top plan view of a second modified form of fluid spring according to this invention.
Figure 7:
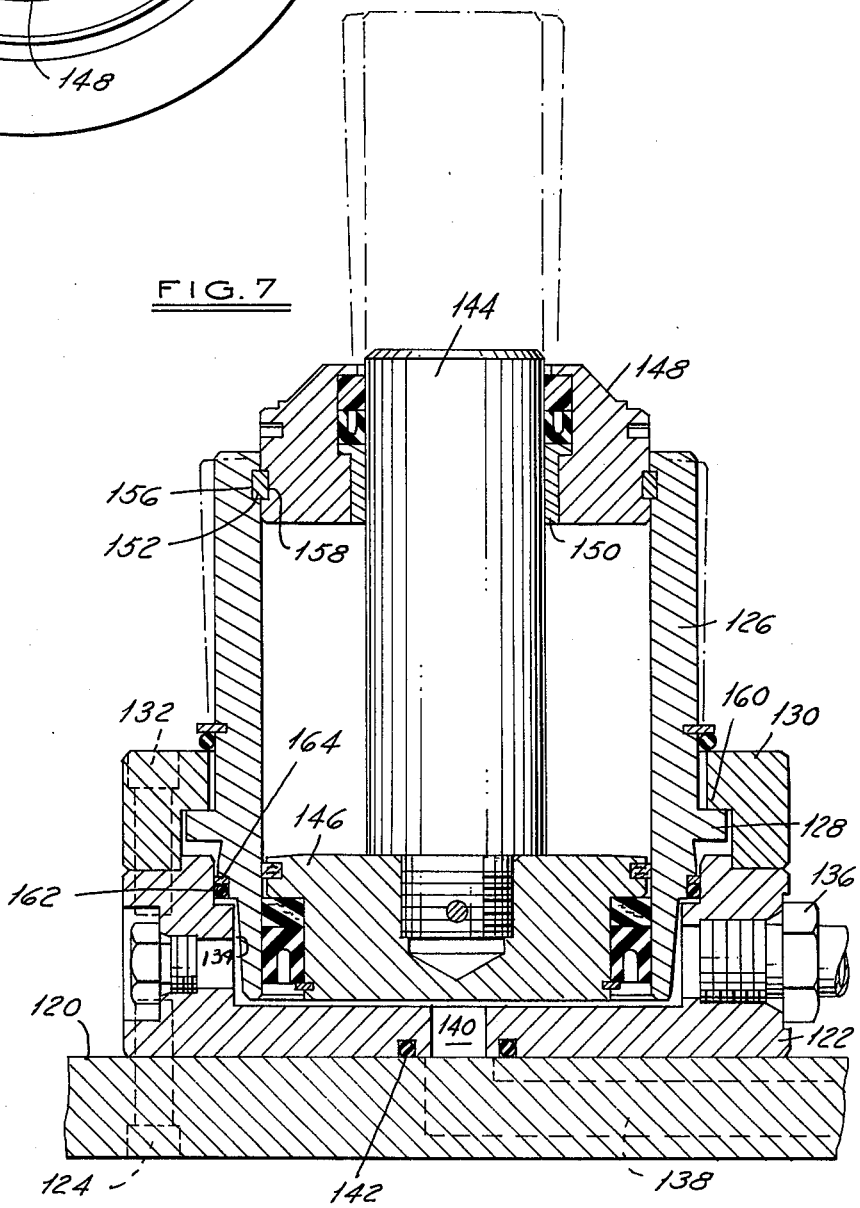
FIG. 7 is a vertical sectional view of the fluid spring shown in FIG. 6.

In the arrangement shown in FIGS. 6 and 7 the fluid spring is adapted to be mounted on the top face of a manifold plate 120. The assembly includes a circular base plate 122 secured to manifold plate 120 by a plurality of screws 124. The cylinder sleeve 126 is formed adjacent its lower end with a radially outwardly extending shoulder 128 by means of which the cylinder sleeve 126 is clamped on base plate 122 by a clamping ring 130 secured in place by a plurality of screws 132. The lower end of cylinder sleeve 126 projects into a bore 134 formed in base plate 122. In the embodiment illustrated base plate 122 is provided with an inlet fitting 136 for directing gas under pressure to the lower end of cylinder sleeve 126. In the event that it is desired to introduce the pressure fluid to the cylinder through the manifold plate, fitting 136 is replaced with a plug and the gas is directed to the lower end of the cylinder through a passageway 138 in manifold plate 120 which communicates with a central opening 140 in base plate 122. An O-ring 142 forms a seal around opening 140.

As in the previous embodiments illustrated, within cylinder sleeve 126 there is arranged a piston rod 144 having a piston 146 secured to the lower end thereof. The upper end of rod 144 projects through a vented bushing 148 provided with a bronze sleeve 150. Bushing 148 is secured to the upper end of cylinder sleeve 126 by a flexible wire key 152. Bushing 148 is cut away at one side thereof as at 154 to enable insertion of and withdrawal of key 152 from the keyway slots 156,158 in sleeve 126 and bushing 148, respectively.

It will be observed that shoulder 128 on sleeve 126 and the radially inwardly extending shoulder 160 on ring 130 are square relative to each other. It will also be noted that sleeve 126 is dimensioned to have a clearance fit in ring 130 and base 122 so that cylinder sleeve 126 as a whole is capable of tilting slightly on base 122. An O-ring 162 in combination with a backing ring 164 forms a seal between the outer periphery of cylinder sleeve 126 and base 122. O-ring 162 maintains this sealed relation while permitting sleeve 126 to tilt slightly about its central axis. When sleeve 126 tilts, at one side thereof shoulder 128 rocks on shoulder 160 and on the diametrically opposite side thereof shoulder 128 moves downwardly away from shoulder 160. However, when the axial downward load on rod 144 is relieved piston 146 moves to the upper end of cylinder 126 by reason of the fluid pressure at the lower end thereof. Piston 146 bottoms on bushing 148. Thereafter the pressure on the underside of the piston will tilt the cylinder sleeve about the contact point between shoulders 128,160 and thereby cause the cylinder to again assume a vertical position.

Figure 8:
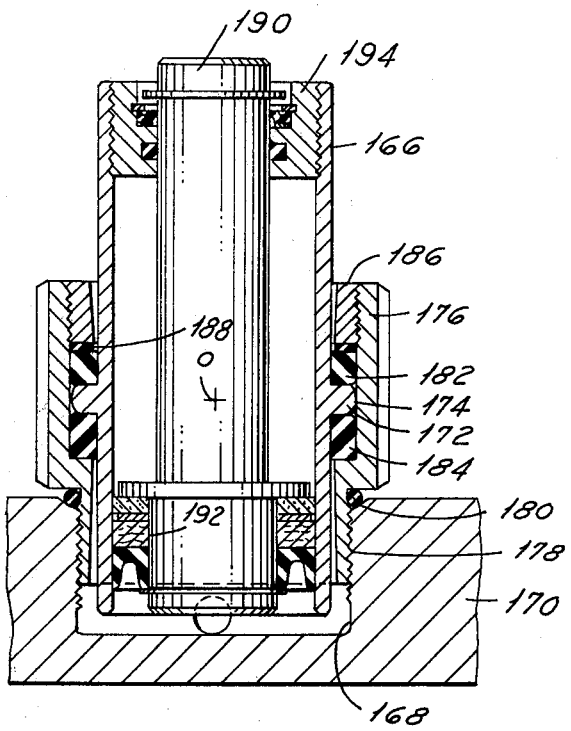
FIGS. 8 and 9 are vertical sectional views of third and fourth modifications of fluid springs according to the present invention.

In the arrangement illustrated in FIG. 8 the cylinder sleeve 166 has its lower end projecting into a bore 168 in adapter plate 170. Cylinder sleeve 166 is formed with an annular outwardly extending shoulder 172 having a rounded contour 174 around its outer periphery. A clamping sleeve 176 surrounds the lower portion of cylinder sleeve 166. Clamping sleeve 176 is threaded into bore 168 as at 178 and is sealed therein by an O-ring 180. Adjacent shoulder 172 clamping ring 176 is radially enlarged. A pair of resilient sleeves 182, 184, formed of rubber or the like, are arranged in compressed relation between cylinder sleeve 166 and clamping sleeve 176, one above and one below shoulder 172. An annular bushing 186 is threaded into the upper end of clamping sleeve 176 to place sleeves 182, 184 in compression. Preferably a back-up ring 188 is disposed between the upper side of resiliently flexible sleeve 182 and the lower end of bushing 186.

As in the embodiments previously described, within cylinder sleeve 166 there is arranged a piston rod 190 having a piston 192 fixedly secured to the lower end thereof. The upper end of rod 190 extends through a vented bushing 194 threaded into the upper end of cylinder 166.

With the above described arrangement the rounded or crowned contour 174 on shoulder 172 enables cylinder sleeve 166 to tilt slightly about the point O. Above and below shoulder 172 cylinder sleeve 166 has a slight clearance with bushing 186 and clamping sleeve 176 to accommodate this tilting movement. The inherent resilience of sleeves 182,184 tends to cause cylinder sleeve 166 to assume an upright position when the piston retracts. If desired, to further insure a good seal between the outer periphery of cylinder sleeve 166 and clamping sleeve 176 sleeves 182,184 may be cemented in place.

Figure 9:
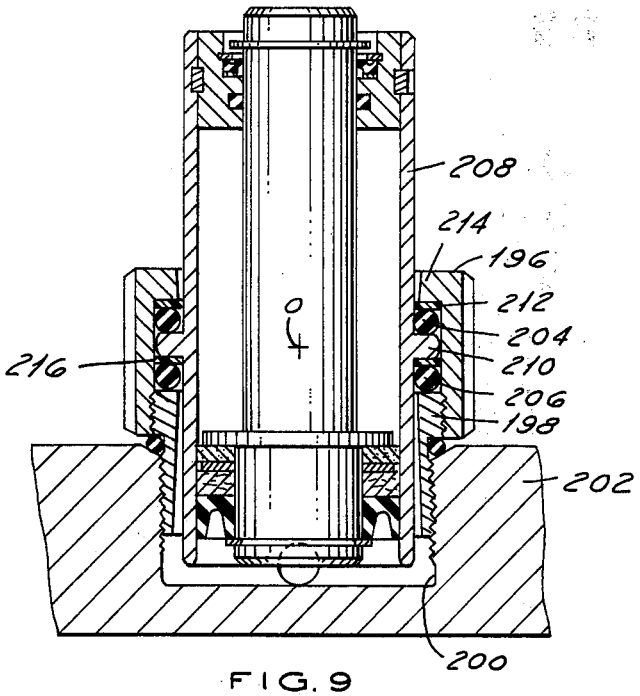

The arrangement shown in FIG. 9 is very similar to that illustrated in FIG. 8. However, the clamping ring 196 is threaded on the upper end of a sleeve 198 which is in turn threaded into the bore 200 in adapter plate 202. In addition, instead of utilizing sleeves as shown in FIG. 8, in the arrangement shown in FIG. 9 two O-rings 204,206 are arranged around cylinder sleeve 208, one above and one below the radially outwardly extending shoulder 210 on the cylinder sleeve. A back-up ring 212 is positioned between the upper O-ring 204 and the inner face of the square shoulder 214 on cylinder sleeve 208. A similar back-up ring 216 is located between the lower O-ring 206 and the lower face of shoulder 210. In a manner similar to that described with reference to FIG. 8, cylinder sleeve 208 is capable of tilting slightly about the point O. When the load on the piston rod is relieved, the inherent resilience of O-rings 204,206 tends to cause cylinder sleeve 208 to assume a vertical position.

It will be apparent that an obvious modification of FIGS. 8 and 9 is a combination thereof; that is, a resilient sleeve such as shown at 182 in FIG. 8 could be utilized for straightening the cylinder when the load thereon is relieved and a rubber O-ring such as shown at 206 in FIG. 9 could be used to form the seal between the outer periphery of the tilting cylinder and the outer clamping ring.

I claim:

1. In a die assembly of the type which includes a pair of spaced apart die members which are mounted on a pair of supports guided for relative movement toward and away from each other in a rectilinear path to form a workpiece between the dies, the combination comprising, a plurality of fluid springs extending between at least one of said die members and its respective support, said springs yieldably biasing the die member in a direction away from its support, each of said fluid springs comprising a fluid cylinder and a piston and piston rod within the cylinder, said piston and piston rod being constrained by said cylinder to move axially therein along a path accurately concentric to the axis of the cylinder, an annular member rigidly mounted on said support with its axis extending parallel to said rectilinear path of die travel, said cylinder being arranged within said annular member generally coaxial therewith and opening at its lower end into said annular member, means tiltably supporting said cylinder within said annular member and resilient means interposed between said annular member and said cylinder and forming a seal therebetween which permits limited tilting movement of the cylinder relative to the axis of the annular member in response to the application of an axial force to the piston rod by its associated die member which is inclined to the central axis of the annular member.

2. The combination called for in claim 1 wherein said cylinder has an outer peripheral surface of cylindrical shape and said annular member has an inner peripheral surface portion of cylindrical shape, said cylindrical surface portions being spaced apart radially and said sealing means being disposed therebetween.

3. The combination called for in claim 1 wherein said supporting means comprises said sealing means.

4. The combination called for in claim 1 wherein said supporting means comprises resiliently flexible ring means interposed between said cylinder and said annular member.

5. The combination called for in claim 4 wherein said ring means is disposed in axial supporting relation between an outer peripheral portion of the cylinder and an inner peripheral portion of the annular member.

6. The combination called for in claim 4 wherein said ring means normally bias said cylinder to assume a position generally coaxial with said annular member.

7. The combination called for in claim 6 wherein said ring means comprises said sealing means.

8. The combination called for in claim 7 wherein said cylinder has an outer peripheral surface of cylindrical shape and said annular member has an inner peripheral surface portion of cylindrical shape, said cylindrical surface portions being spaced apart radially and said sealing means being disposed therebetween.

9. The combination called for in claim 4 wherein said cylinder and said annular member are formed with axially spaced radially extending shoulders which are axially opposed, said ring means being disposed between said shoulders.

10. The combination called for in claim 9 wherein said ring means comprises at least one elastomer sleeve.

11. The combination called for in claim 9 wherein said ring means comprises at least one O-ring.

12. The combination called for in claim 4 wherein said ring means comprises said sealing means.

13. The combination called for in claim 4 wherein one of said annular member and cylinder is formed with a pair of axially spaced radially extending shoulders which are axially opposed and the other is formed with a shoulder thereon projecting radially into the space between said pair of shoulders, said ring means comprising a pair of rings interposed one between each pair of spaced shoulders and the radial shoulder therebetween.

14. The combination called for in claim 13 wherein said pair of rings and said shoulders are axially interengaged to axially support the cylinder within said annular member.

15. The combination called for in claim 14 wherein each of said rings sealingly engages the outer periphery of said cylinder and the inner periphery of said annular member and comprises said sealing means.

16. The combination called for in claim 1 wherein said support has a bore therein to which fluid under pressure is directed, the lower end of said cylinder communicating with said bore and including means forming a sealed connection between said annular member and said support around said bore.

17. The combination called for in claim 1 wherein said supporting means comprises a pair of axially interengaged shoulders on said cylinder and annular member.

18. The combination called for in claim 17 wherein at least one of said shoulders is rounded to facilitate tilting movement of said cylinder within said annular member.

19. The combination called for in claim 16 wherein the lower ends of said annular member and said cylinder extend axially into said bore and the upper end of said cylinder projects upwardly beyond the upper end of the annular member.

20. The combination called for in claim 19 wherein said supporting means are located closer to the plane of said support than from the upper end of the cylinder.

* * * * *